US006139015A

United States Patent [19]

Hsieh

[11] Patent Number: 6,139,015

[45] Date of Patent: Oct. 31, 2000

[54] MAZE TOY HAVING CHANGEABLE TRACKS

[76] Inventor: Frank Hsieh, 9th-1 Floor, Kuang Fu South Road, Taipei, Taiwan

[21] Appl. No.: 09/305,804

[22] Filed: Apr. 22, 1999

[51] Int. Cl.[7] ..... A63F 7/04

[52] U.S. Cl. ..... 273/153 R; 273/153 S; 273/109

[58] Field of Search ..... 273/109–117, 153 S, 273/153 R

[56] References Cited

U.S. PATENT DOCUMENTS 3,749,405 7/1973 Grattoni .
4,008,895 2/1977 Reiner et al. .
4,667,960 5/1987 Stefanini .
4,685,679 8/1987 Ben-Gal .
4,754,972 7/1988 Boskovic .
4,822,047 4/1989 Treer .

*Primary Examiner*—William M. Pierce
*Attorney, Agent, or Firm*—Browdy and Neimark

[57] ABSTRACT

A maze toy is formed of a base, a movable element, and a housing. The base is of a three-dimensional construction and is formed of a plurality of two-dimensional planes such that at least two adjoining planes of the periphery of the base form jointly a layout area which is provided with a plurality of separation portions forming a three-dimensional and intricate track in which the movable element travels. The housing is used to seal off the layout area. The base is formed of at least two pivoted subbases and a rotating mechanism for turning the two subbases so as to enable the maze toy to have a plurality of changeable tracks.

9 Claims, 3 Drawing Sheets

MAZE TOY HAVING CHANGEABLE TRACKS

FIELD OF THE INVENTION

The present invention relates generally to a maze toy, and more particularly to a three-dimensional maze toy having an intricate network of changeable tracks for amusement.

BACKGROUND OF THE INVENTION

The conventional maze toy is used for a psychological game in which a player is encountered with a confusing and intricate network of winding pathways. There are generally two kinds of the maze structure. The first kind of the maze structure makes use of a paper sheet on which a number of lines are drawn separately such that there are confusing and intricate pathways between the two separate lines. The pathways are drawn on the planar surface of the paper to test if one can arrive at the destination from the departure along a selected pathway. On the other hand, the second kind of the maze structure involves a flat plate on which a plurality of partitions are erected such that a confusing and intricate network of winding pathways is formed by the partitions. A steel ball is started out at a departing point to search for a pathway that leads the steel ball to arrive at a destination. Such a maze game as described above is played simultaneously by a plurality of persons on a competitive basis.

The conventional maze structures are formed of two-dimensional pathways or tracks, which are incapable of forming a high degree of intricacy according to the principles of logic, or correct reasoning. In light of the conventional maze toy being formed of partitions and a steel ball, the conventional maze toy is incapable of providing a player thereof with a mental challenge demanding a special effort or dedication. For this reason, an improved maze toy was developed such that it was formed of a number of three-dimensional pathways or tracks for increasing the complexity of the game. However, this three-dimensional maze toy as described above is limited in design in that the pathways or tracks are fixed, thereby denying a player thereof a freedom of choice.

SUMMARY OF THE INVENTION

The primary objective of the present invention is to provide a three-dimensional maze toy having changeable pathways for enhancing the amusement value of the maze toy.

In keeping with the principle of the present invention, the foregoing objective of the present invention is attained by a maze toy including a base, a movable element, and a housing. The base is of a three-dimensional pattern and is formed of a plurality of two-dimensional planes such that at least two adjoining planes of the periphery of the base form jointly a layout area which is provided with a plurality of separation portions forming a three-dimensional and intricate pathway in which the movable element travels. The housing is used to seal off the layout area. The present invention is characterized that the base is formed of at least two pivoted subbases and a rotating mechanism for turning the two subbases.

The foregoing objective, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
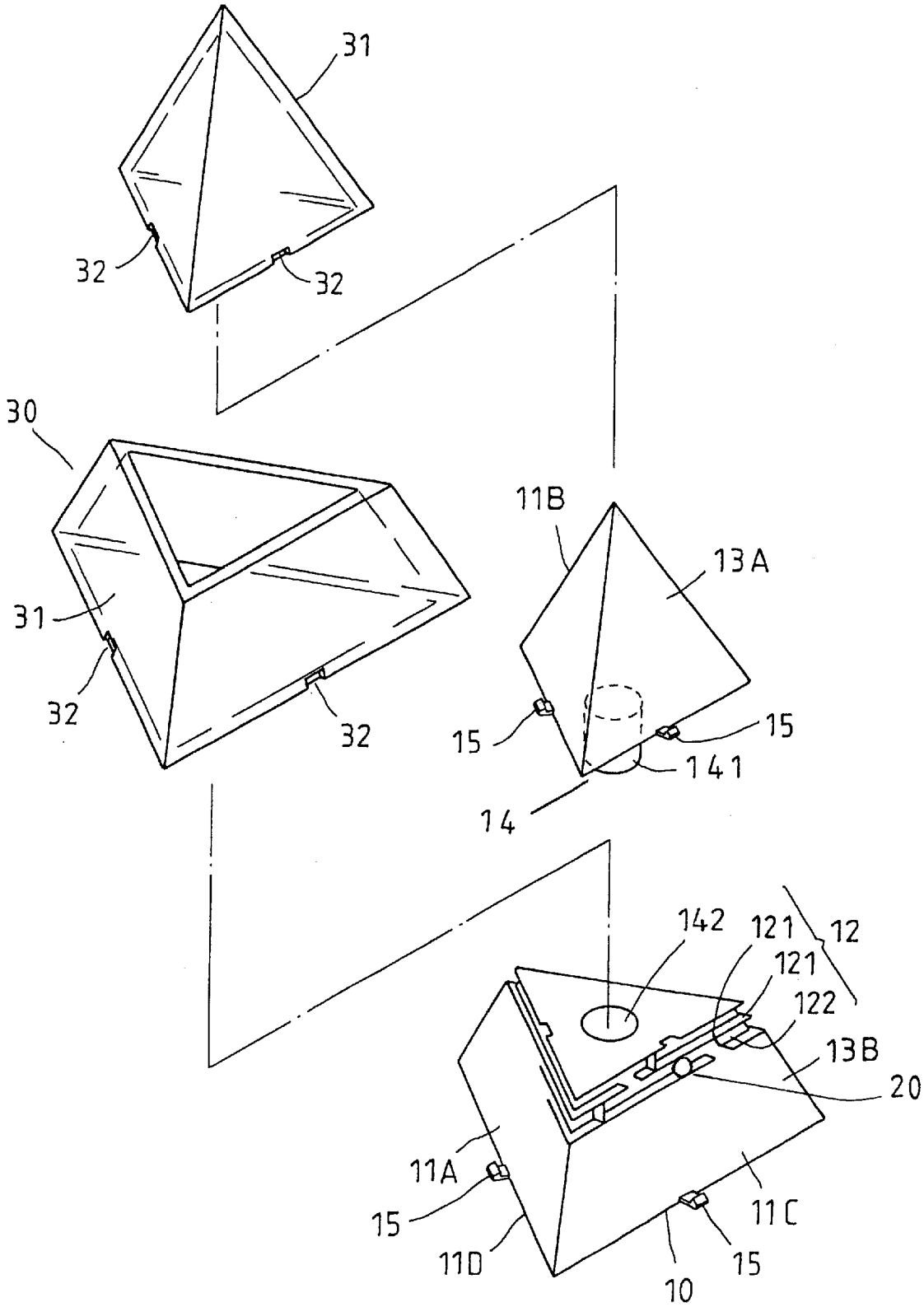
FIG. 1 shows an exploded view of a base of a first preferred embodiment of the present invention.

As shown in FIG. 1, a three-dimensional maze toy embodied in the present invention is provided with a plurality of changeable tracks and is formed of a base 10, a movable element 20, and a housing 30. The base 10 is formed of four two-dimensional planes 11 which are joined together and closed completely to form a three-dimensional pyramidal body. The four two-dimensional planes are formed respectively of three tapered surfaces 11A, 11B and 11C, and a bottom surface 11D, which form together a layout area 12. The layout area 12 is provided with a plurality of separation portions 121 which form therebetween an intricate, three-dimensional pathway 122. The layout area 12 is provided with one destination which is located at a center of the bottom surface 11D, and another destination which is the top point of the three tapered surfaces 11A, 11B and 11C. The base 10 is formed of two subbases 13A and 13B, and a rotating mechanism 14 disposed between the two subbases 13A and 13B. The rotating mechanism 14 has a rotary shaft 141 extending outward from the connection end of the first subbase 13A. The second subbase 13B has a connection end which is provided with a pivoting hole 142 in which the rotary shaft 141 is fitted pivotally. The two subbases 13A and 13B are provided with a retaining portion 15. The movable element 20 is a steel ball capable of rolling in the three-dimensional pathway (track) 122. The housing 30 is transparent and is formed of two subhousings 31 which are provided with a retaining hole 32 corresponding in location to and engageable with the retaining portion 15 of the subbases 13A and 13B. As a result, the two subhousings 31 are joined respectively with the outer periphery of the subbases 13A and 13B, so as to prevent the steel ball 20 from jumping the track 122. In operation, a player has the option to start out from the destination located at the center of the bottom surface 11D to move on to another destination at the top point of the tapered surfaces 11A, 11B and 11C. The player may choose to start out from the bottom surface 11D to proceed via the tapered surface 11A, or from the bottom surface 11D to complete the entire moving range via the three tapered surfaces 11A, 11B and 11C. As a result, the player is provided with the three-dimensional changeable tracks according to the principle of logic, or correct reasoning. In addition, the three-dimensional track of the present invention can be changed in accordance with the player's preference by adjusting the relative positions of the layout areas 12 on the subbases 13A and 13B. In other words, the subbases 13A and 13B are turned 120 degrees to enable the peripheral surfaces of the subbases 13A and 13B to join together, thereby resulting in the formation of a three-dimensional track. The first preferred embodiment of the present invention has therefore three different tracks.

Figure 2:
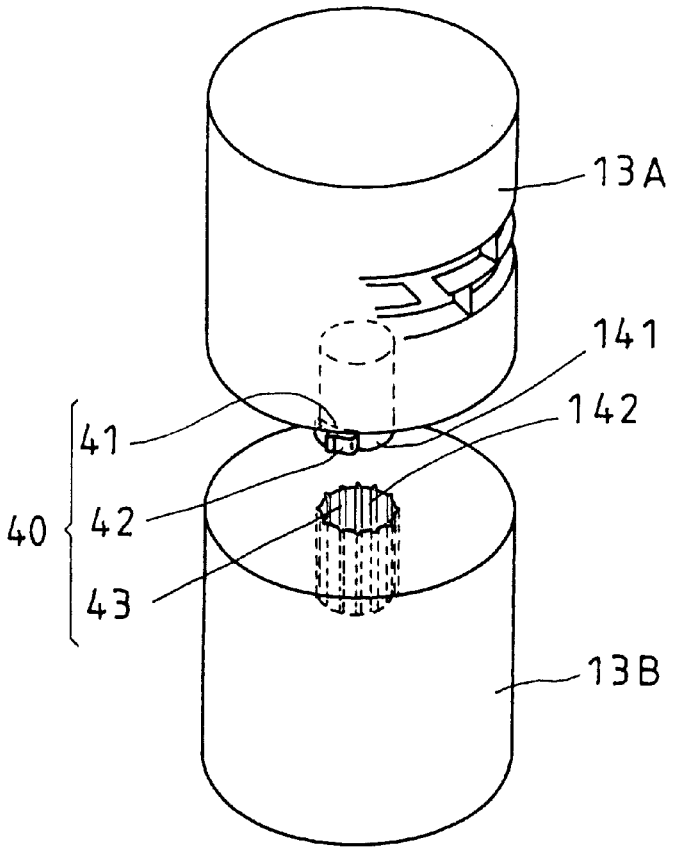
FIG. 2 shows an exploded view of a base of a second preferred embodiment of the present invention.
Figure 3:
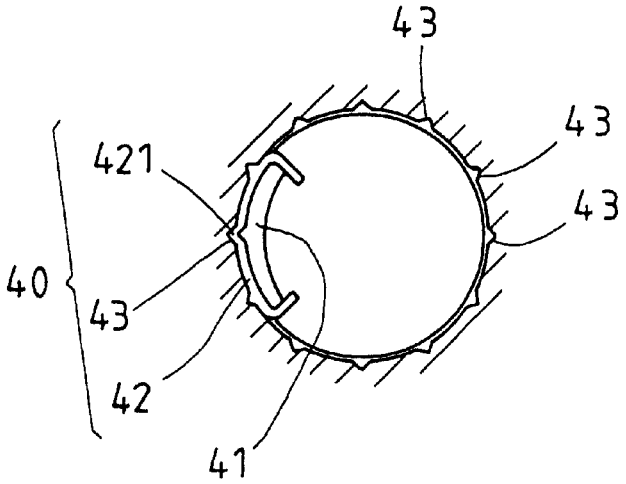
FIG. 3 shows a sectional view of a locating member of the second preferred embodiment as shown in FIG. 2.

As shown in FIGS. 2 and 3, the second preferred embodiment of the present invention is different from the first preferred embodiment of the present invention in that the former is formed of a cylindrical base 10 which is constructed by a plurality of two-dimensional planes that are joined together. In light of the base 10 being cylindrical in construction, the peripheral surfaces of the two subbases 13A and 13B can be always fitted together even if the subbases 13A and 13B are turned to any relative angle. As a result, the three-dimensional track can be changed from one form to another. However, the second preferred embodiment of the present invention is provided with a locating set 40, which is shown in FIG. 2 and is provided with a fastening slot 41 located in the rotary shaft 141 of the first subbase 13A. The fastening slot 41 is provided therein with a locating member 42 having an arcuate body of an elastic material, and a locating protrusion 421. The second subbase 13B has a pivoting hole 142, which is provided in the inner wall thereof with a plurality of locating slots 43 that are separated from one another at a predetermined angle. When the two subbases 13A and 13B are turned in relation to each other, the locating protrusion 421 of the locating member 42 is retained in one of the locating slots 43.

Figure 4:
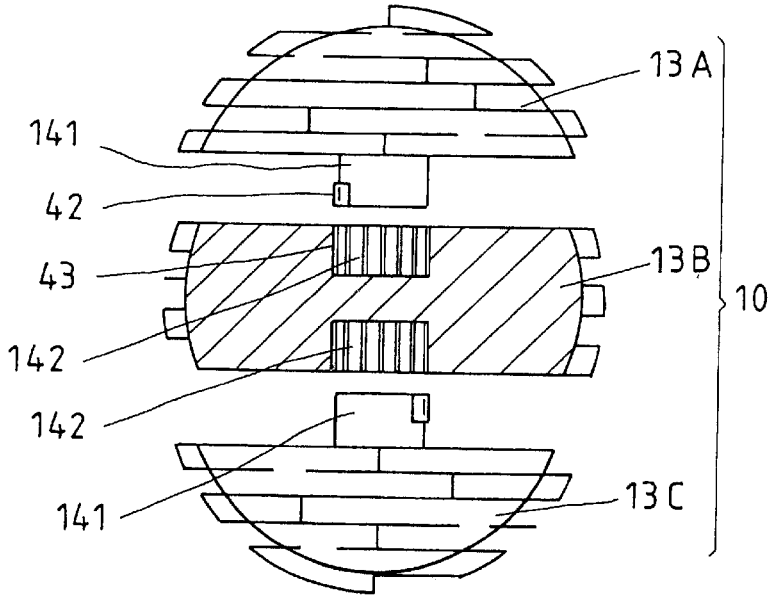
FIG. 4 shows a sectional view of a base of a third preferred embodiment of the present invention.

As shown in FIG. 4, the third preferred embodiment of the present invention is different from the second preferred embodiment of the present invention in that the base 10 of the former is formed of a plurality of two-dimensional planes which are joined together to form a closed spherical body. The base 10 has three subbases 13A, 13B and 13C, which are respectively designated as a North Pole area, an equator area, and a South Pole area. A rotating mechanism 14 is provided between each pair of the subbases 13A, 13B, and 13C to facilitate the modulating of the three-dimensional track.

Figure 5:
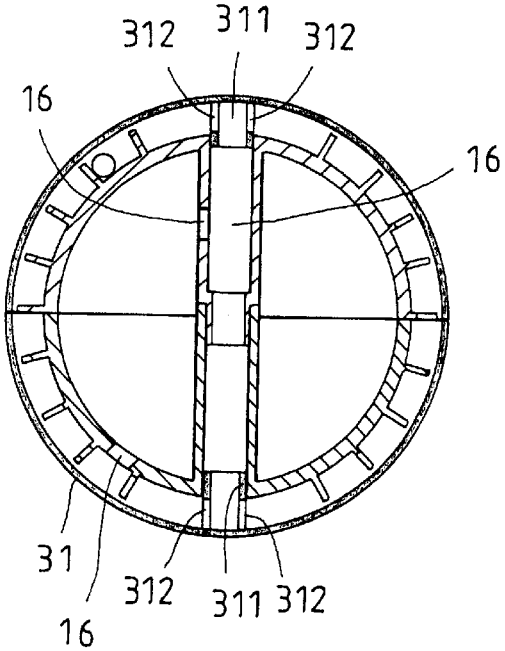
FIG. 5 shows a sectional view of a fourth preferred embodiment of the present invention.

Now referring to FIG. 5, the fourth preferred embodiment of the present invention is shown to be different from the third preferred embodiment of the present invention in that the base 10 of the former is provided with a through hole 16 located between the North Pole subbase 13A and the South Pole subbase 13C, and that the subhousings 31 is provided with a passageway 311 having an exit 312. The passageway 311 can be inserted into the through hole 16 of the base 10 for the movable element 20 to travel from the departing point of the North Pole subbase 13A along the three-dimensional track to the destination point of the South Pole subbase 13C, and then back to the departing point via the exit 312 and the passageway 311.

Figure 6:
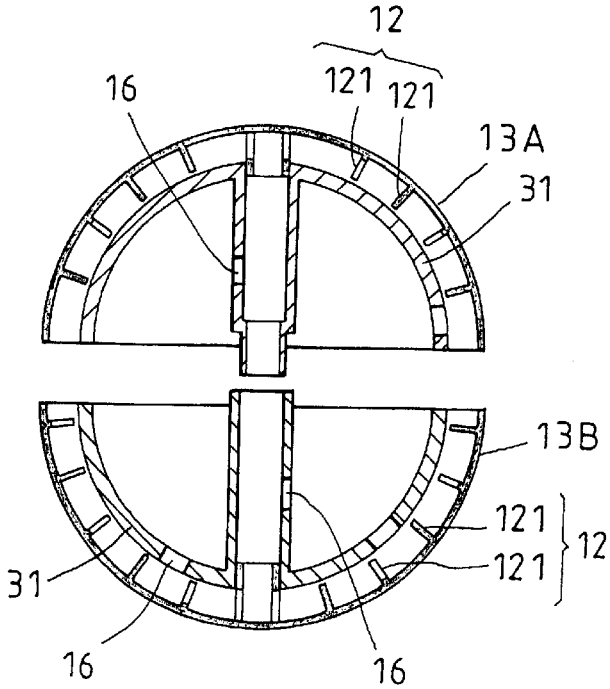
FIG. 6 shows a sectional view of a fifth preferred embodiment of the present invention.

As shown in FIG. 6, the fifth preferred embodiment of the present invention is provided with a plurality of layout areas 12 which are located in the inner surface of the base 10, and a housing 30 which is smaller in profile than the layout area 12 of the base 10. The housing 30 is concealed in the base 10 such that the layout area is sealed off by the housing 30.

The subhousings 31 of the present invention may be joined together in other manner such as a locking structure. Similarly, the rotating mechanisms of the subbases 13A and 13B are not confined to those which were described above. Other rotating means, such as a sleeve spindle, a steel ball, etc., may be used. In order to enhance the amusement value of the base 10, the base 10 may be provided with a plurality of through holes 16 which are in communication with one another and extend to reach the surface of the layout area 12, thereby providing the base 10 with a concealed three-dimensional track. The present invention may be embodied in other specific forms without deviating from the spirit thereof. The present invention is therefore to be limited only by the scopes of the following appended claims.

What is claimed is:

1. A maze toy having changeable tracks and comprising a base, a movable element, and a housing, said base formed of a plurality of two-dimensional planes as a three-dimensional structure which is provided in the periphery thereof with a layout area formed by at least two two-dimensional planes adjacent to each other, said layout area provided with a plurality of separation portions forming therebetween an intricate three-dimensional track in which said movable element travels, said layout area being sealed off by said housing; wherein said base is formed of at least two subbases and a rotating mechanism provided between said two subbases for turning said two subbases, and wherein said locating set is a fastening slot located in said rotary shaft for fastening an arcuate locating member having a locating protrusion; and wherein said pivoting hole is provided with a plurality of locating sots arranged in a predetermined angle such that said locating protrusion of said locating member is selectively retained in said locating slots.

2. The maze toy as defined in claim 1, wherein said rotating mechanism has a rotary shaft mounted on one of said two subbases, and a pivoting hole located in other one of said two subbases.

3. The maze toy as defined in claim 1, wherein said rotating mechanism is provided with a locating set.

4. The maze toy as defined in claim 2, wherein said rotating mechanism is provided with a locating set.

5. The maze toy as defined in claim 1, wherein said base is provided with at least one through hole extending through an interior of said base to reach an outer surface of said base.

6. The maze toy as defined in claim 5, wherein said subhousings are provided with at least one passageway which is inserted into said through hole; and wherein said through hole is provided at one end thereof with an exit.

7. The maze toy as defined in claim 1, wherein said layout area is disposed in an outer periphery of said base; and wherein said layout area is sealed off by said housing.

8. The maze toy as defined in claim 1, wherein said layout area is disposed in an inner periphery of said base; and wherein said layout area is sealed off by said housing.

9. The maze toy as defined in claim 1, wherein said housing is provided with a plurality of subhousings which are equal in number to said subbases and are joined with said subbases.

* * * * *